United States Patent [19]

Baram

[11] 3,930,608

[45] Jan. 6, 1976

[54] CENTRIFUGE

[75] Inventor: Martin Baram, Delft, Netherlands

[73] Assignee: Escher Wyss Limited, Zurich, Switzerland

[22] Filed: Sept. 10, 1973

[21] Appl. No.: 396,056

[30] Foreign Application Priority Data

Sept. 11, 1972 Denmark ..... 4469/72

[52] U.S. Cl. ..... 233/3; 233/20 A; 233/46

[51] Int. Cl. ..... B04b 1/12

[58] Field of Search ..... 233/3, 7, 8, 9, 20 R, 20 A, 233/27, 28, 46, 47 R

[56] References Cited

UNITED STATES PATENTS

| | | | |
|---|---|---|---|
| 499,349 | 6/1893 | Peck | 233/7 |
| 686,917 | 11/1901 | Baker | 233/20 R |
| 1,640,707 | 8/1927 | Laughlin | 233/20 R |
| 2,276,824 | 3/1942 | Carruthers | 233/20 R |
| 2,308,559 | 1/1943 | Winkler | 233/7 X |
| 3,771,715 | 11/1973 | Baram | 233/27 |

FOREIGN PATENTS OR APPLICATIONS

| | | | |
|---|---|---|---|
| 998,669 | 7/1965 | United Kingdom | 233/7 |
| 157,520 | 1/1957 | Sweden | 233/27 |
| 902,500 | 12/1944 | France | 233/7 |
| 406,362 | 11/1943 | Switzerland | 233/7 |
| 342,161 | 7/1936 | Italy | 233/20 R |

*Primary Examiner*—George H. Krizmanich
*Attorney, Agent, or Firm*—Robert A. Ostmann

[57] ABSTRACT

A centrifuge with a solid-walled drum subdivided into two zones, in the first of which the movement of the solids is controlled by a pushing means, and in the second of the two zones a deposition channel for the solids is arranged, said channel being located outside the region of said pushing means and having a bottom outlet for the solids.

6 Claims, 2 Drawing Figures

CENTRIFUGE

BACKGROUND OF THE INVENTION

This invention relates to a centrifuge having a rotatable solid-walled drum with an inlet for the mixture to be centrifuged, which consists of liquid and solids, an overflow for the clarified liquid, and an outlet for the solids and also having a pushing means for controlling the movement of the solids in the solid-walled drum towards the outlet for the solids.

Known centrifugal clarifiers of this kind have a conical solid-walled drum, and the pushing means disposed in the latter comprises a worm which rotates at a different speed from that of the solid-walled drum. The overflow for the clarified liquid is situated at the wider end of the conical solid-walled drum. The outlet for the solid material is situated at the narrower end of the conical solid-walled drum, and is located above the level of liquid of the clarified liquid overflow.

It is a disadvantage of these known centrifugal clarifiers that the solid-walled drum and the worm must be conical, so that manufacture is made more expensive. Another more serious disadvantage of these known centrifugal clarifiers is the fact that they are suitable only for treating mixtures which have a dry substance concentration of at least 2.5% solids in the mixture. Moreover, the diameter of the solid particles must not be under 3.0 $\mu$.

SUMMARY OF THE INVENTION

The problem underlying the invention consists in providing a centrifuge which can be simpler in construction, but which above all permits the separation of mixtures having a lower dry substance content and substantially smaller particle size.

According to the invention this problem is solved by subdividing the solid-walled drum into two zones, in the first of which the removal of the solids is controlled by the pushing means, while in the second zone a deposition channel situated outside the region of the pushing means is provided for the solids, while a bottom outlet provided at the base of the deposition channel serves as the outlet for the solids.

The portion of the solid-walled drum, bearing deposited solids is advantageously situated in both zones below the overflow for the clarified liquid, so that both zones have a common liquid level.

It is advantageous for at least a part of the solid-walled drum to be cylindrical in the first zone.

Furthermore, it is advantageous for the bottom outlet for the solids to be controllable. In this case the bottom outlet for the solids may advantageously be formed by two rings which are axially slidable in relation to one another. These rings are advantageously adapted to be pressed towards one another in the axial direction by means of a spring.

BRIEF DESCRIPTION OF THE DRAWING

Embodiments of the invention are illustrated in simplified form in the drawing, with the aid of which the invention will be more fully described and in which.

DESCRIPTION OF THE PREFERRED EMBODIMENTS

Figure 1:
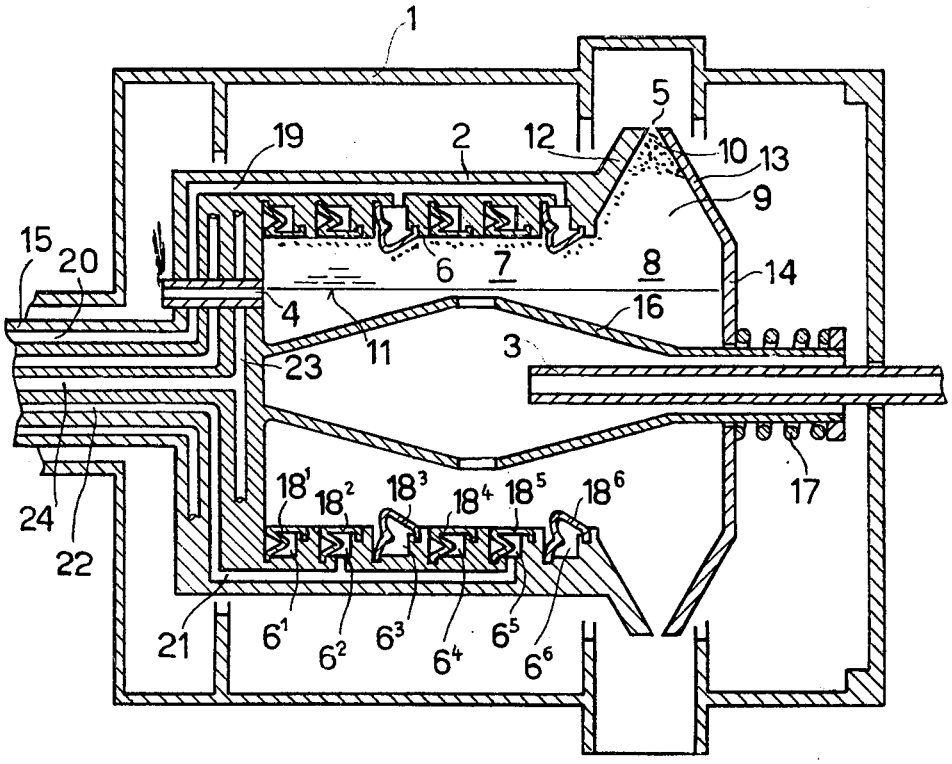
FIG. 1 is an axial longitudinal section through a centrifuge.

The centrifuge shown in FIG. 1 has a solid-walled drum 2 which is mounted for rotation in a casing 1 and is provided with an inlet 3, consisting of a tube, for a mixture of liquid and solids which is to be centrifuged, an overflow 4 formed by a length of tubing, for the clarified liquid, and an outlet 5 for the solids. The solid-walled drum 2 contains a pushing means 6 for controlling the movement of the solids in the solid-walled drum 2 towards the solids outlet 5.

The solid-walled drum 2 is subdivided into two zones 7 and 8, in the first of which, namely the zone 7, the movement of the solids is controlled by the pushing means 6, while in the second, namely the zone 8, a deposition channel 9 for the solids is provided, this channel being situated outside the region of the pushing means 6. A bottom outlet 10 provided at the base of the deposition channel 9 serves as outlet 5 for the solids.

The portion of the solid-walled drum 2 containing deposited solids, namely the portion in which the pushing means 6 is disposed and the portion which forms the deposition channel 9, extends in both zones 7 and 8 below the overflow 4 for the clarified liquid, so that both zones 7 and 8 have a common liquid level 11.

In the first zone 7, the solid-walled drum 2 is cylindrical.

The bottom outlet 10 for the solids is controllable. It is formed by two rings 12 and 13 of the solid-walled drum 2, which are axially slidable in relation to one another. The ring 12 is fastened to the cylindrical portion of the solid-walled drum 2. The ring 13 is mounted on a lid 14 of the solid-walled drum 2. By means of an acceleration funnel 16 provided for the mixture entering through the inlet 3 and fastened on the shaft 15 of the solid-walled drum 2, the lid 14 and consequently the ring 13 can be pressed towards the ring 12. For this purpose use is made of a spring 17 disposed between the free end of the acceleration funnel 16 and the lid 14.

On their way to the outlet 5 the solids no longer need to be raised above the level of liquid and pushed in a rather dry condition through the solid-walled drum, but are moved below the liquid level 11 in the drum. Because of the pushing means 6 extending over its length, the first zone 7 may be very long in the axial direction. In the deposition channel 9 the solid particles form bridges with one another so that a fine filter layer formed by the solids is built above the bottom outlet 10. In this way it is possible for mixtures having a dry substance concentration of only 0.2% solids in the mixture also to be centrifuged without difficulty, and the diameter of the solid particles may be very small, for example amounting to 0.7 $\mu$. With the aid of the pushing means the treatment time can be controlled, while the bottom outlet of the deposition channel controls the discharge of the solids. This results in a qualitatively and quantitatively more efficient centrifuge.

The pushing means 6 has six annular cylinders $6^1$ to $6^6$, which are covered by diaphragms $18^1$ to $18^6$. For example, the diaphragm $18^1$ forms a flexible piston for the annular cylinder $6^1$, the diaphragm $18^2$ forms a flexible piston for the annular cylinder $6^2$, and so on.

The annular cylinders $6^3$ and $6^6$ are connected by pipes 19 to a pipe 20 disposed in the shaft 15. The annular cylinders $6^2$ and $6^5$ are connected to a pipe 22 disposed in the shaft 15 by means of a pipe 21 corresponding to the pipe 19. The annular cylinders $6^1$ and $6^4$ are connected to a pipe 24 disposed in the shaft 15 by means of a pipe 23 which corresponds to the pipe 19 and which is only partly shown in the drawing.

The pushing means 6 can be operated by means of a pressure medium source and negative source (not shown.) In the position shown in the drawing the diaphragms $18^3$ and $18^6$ are at the end of their pushing position, that is to say in the erected state. The diaphragms $18^2$ and $18^5$ and also the diaphragms $18^1$ and $18^4$ are in the position of rest. In this case the pipe 20 is under pressure and the pipes 22 and 24 under negative pressure. By alternate erection of the groups of diaphragms $18^1$ and $18^4$, $18^2$ and $18^5$, or $18^3$ and $18^6$ the solids in the solid-walled drum can be moved towards the outlet 5 in the latter.

Figure 2:
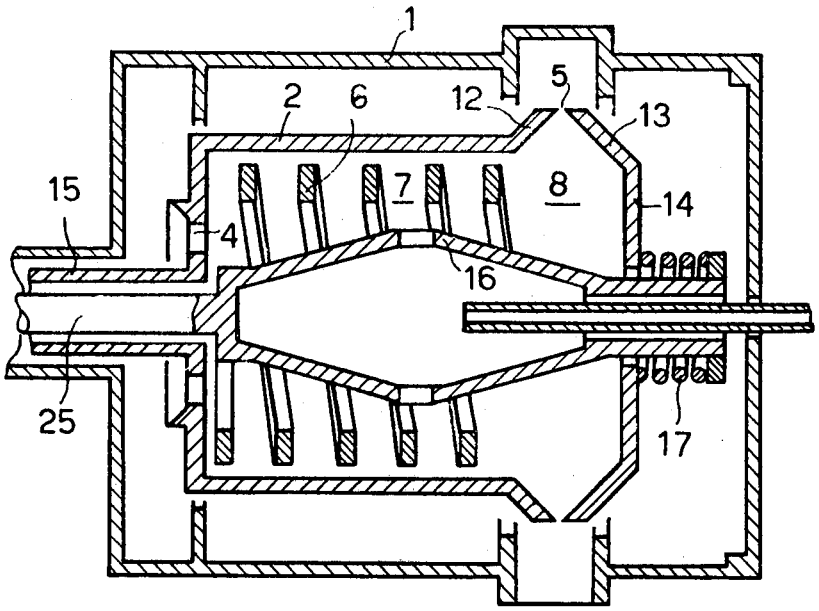
FIG. 2 an axial longitudinal section through another centrifuge.

In the embodiment illustrated in FIG. 2 the pushing means 6 is formed by a worm fastened on a shaft 25 which also carries the acceleration funnel 16. The shaft 25 is mounted for rotation in the shaft 15 of the solid-walled drum 2, the shaft 15 being hollow. The shafts 25 and 15 rotate at different speeds, so that the solids deposited on the solid-walled drum 2 in the first zone 7 is moved in the drum towards the outlet 5.

Between the ring 12 and the ring 13 of the bottom outlet 10 there is here a mutual rotation which prevents the clogging of the bottom outlet 10, If desired, however, a ball bearing may be incorporated between the spring 17 and the lid 14. Furthermore, guides for preventing the mutual rotation of the two rings 12 and 13 may be provided between these rings. In this case the two rings 12 and 13 would rotate at the same speed, which is more favourable for the formation of bridges between the individual solid particles.

In both embodiments the spring 17 is so dimensioned and stressed that the bottom outlet 10 opens under the pressure of the contents of the solid-walled drum 2 when a sufficient, predetermined amount of solids has collected in the deposition channel 9, and that is closes again when the amount has fallen to a smaller, predetermined value.

The expressions "below the level of liquid, below the overflow, deposition channel, at the bottom of the deposition channel" relate to the situation produced by the centrifugal forces. In this sense, for example, "bottom" means located, in respect of the axis of rotation of the solid-walled drum, radially on the outside,

I claim:

1. A centrifuge comprising a solid-walled drum having an inlet for a mixture of liquid and solids which is to be centrifuged, and overflow for the clarified liquid, and an outlet for the solids; and pushing means for controlling movement of the solids in the drum towards said outlet, and characterized in that the drum is subdivided into two zones, the pushing means being located in the first zone and arranged to move solids through this zone and into the second zone, and the second zone having a deposition channel for solids which is located outside the region of the pushing means and has said outlet for solids located at its bottom.

2. A centrifuge as defined in claim 1 in which the drum has a portion which bears deposited solids and extends, in both zones, below said overflow for clarified liquid, whereby both zones have a common liquid level.

3. A centrifuge as defined in claim 1 in which at least part of said drum in the first zone is cylindrical.

4. A centrifuge as defined in claim 1 in which the size of said outlet for solids is adjustable during operation.

5. A centrifuge as defined in claim 1 in which said outlet for solids is formed by two rings which are axially slidable relatively to one another.

6. A centrifuge as defined in claim 5 including a spring which presses the two rings towards one another in the axial direction.

* * * * *